United States Patent [19]

Parker

[11] 4,353,637

[45] Oct. 12, 1982

[54] DEVELOPMENT SYSTEM

[75] Inventor: Delmer G. Parker, Irondequoit, N.Y.

[73] Assignee: Xerox Corporation, Stamford, Conn.

[21] Appl. No.: 297,586

[22] Filed: Aug. 31, 1981

[51] Int. Cl.[3] ..... G03G 15/00

[52] U.S. Cl. ..... 355/3 DD; 355/14 D; 118/653; 118/658; 430/120; 430/122

[58] Field of Search ..... 355/3 DD, 14 D; 118/647, 651, 653, 658, 655, 656; 430/413, 120, 121, 122, 123

[56] References Cited

U.S. PATENT DOCUMENTS

| | | | |
|---|---|---|---|
| 3,008,826 | 11/1961 | Mott et al. | 355/3 DD X |
| 3,095,325 | 6/1963 | Trumbull | 355/3 DD X |
| 3,265,522 | 8/1966 | Games | 355/3 DD X |
| 3,636,924 | 1/1972 | Weiler | 355/3 DD X |
| 3,639,050 | 2/1972 | Staller | 355/3 DD X |
| 3,767,446 | 10/1973 | Weiler | 355/3 DD X |
| 3,953,121 | 4/1976 | Reichart, Jr. | 355/3 DD |
| 4,097,139 | 6/1978 | Hauser et al. | 355/3 DD X |
| 4,181,422 | 1/1980 | Forgo et al. | 355/3 DD X |
| 4,227,796 | 10/1980 | Kamp et al. | 355/3 DD |
| 4,231,319 | 11/1980 | Waibel et al. | 430/121 X |

*Primary Examiner*—A. C. Prescott

*Attorney, Agent, or Firm*—H. Fleischer; J. E. Beck; R. Zibelli

[57] ABSTRACT

An apparatus in which a supply of developer material stored in the chamber of a housing develops a latent image. A transport, disposed in the chamber, moves the developer material into contact with the latent image to form a powder image thereof. As developer material is depleted from the housing, the housing moves automatically toward the transport to furnish a continuous supply of developer material thereto.

32 Claims, 5 Drawing Figures

DEVELOPMENT SYSTEM

This invention relates generally to an electrophotographic printing machine, and more particularly concerns an improved development system for use therein.

Generally, the process of electrophotographic printing includes charging a photoconductive member to a substantially uniform potential so as to sensitize the surface thereof. The charged portion of the photoconductive member is exposed to a light image of an original document being reproduced. This records an electrostatic latent image on the photoconductive member which corresponds to the informational areas contained within the original document. After the electrostatic latent image is recorded on the photoconductive member, the latent image is developed by bringing a developer material into contact therewith. This forms a powder image on the photoconductive member which is subsequently transferred to a copy sheet. Finally, the powder image is permanently affixed to the copy sheet in image configuration.

Frequently, the developer material comprises toner particles adhering triboelectrically to carrier granules. The developer material is brought into contact with the latent image. Toner particles are attracted from the carrier granules to the latent image forming the toner powder image thereof.

With the advent of single component developer materials, carrier granules are no longer required. During development, these particles are deposited on the latent image. As the particles are deposited on the latent image, the supply thereof in the developer housing is depleted. This reduces the quantity of particles available to the developer roller for movement into contact with the latent image. Thus, the developer roller may, in fact, be starved for particles of developer material. Hereinbefore, this problem has been solved by providing a toner dispenser within the developer housing which continually furnishes additional particles to the sump having the developer roller mounted therein. In this way, the particles are maintained at a sufficient level in the sump to prevent starvation of the developer roller. However, this increases the expense associated with the printing machine in that a separate housing and dispenser are required. It would be highly desirable to be able to maintain a constant supply of developer material to the developer roller without the necessity for providing a dispenser within the development system.

Various approaches have been devised to improve development. The following disclosure appears to be relevant: U.S. Pat. No. 4,067,295, Patentee: Parker et al., Issued: Jan. 10, 1978.

The relevant portions of the foregoing disclosure may be briefly summarized as follows:

As shown in FIG. 3 and discussed in col. 3, lines 8–18, inclusive, Parker et al. discloses a hopper containing magnetic toner material. The hopper is constantly vibrated by suitable means to maintain the toner material in a fluent state.

In accordance with one aspect of the features of the present invention, there is provided an apparatus for developing a latent image. Means define a chamber for storing a supply of developer material therein. Means, disposed in the chamber of the storing means, transport the developer material into contact with the latent image to form a powder image thereof. Means are provided for automatically moving the storing means toward the transporting means to provide a continuous supply of developer material to the transporting means.

Pursuant to another aspect of the features of the present invention, there is provided an electrophotographic printing machine of the type having an electrostatic latent image recorded on a photoconductive member. A roller transports developer material into contact with the latent image to form a powder image thereon. Means define a chamber for storing a supply of developer material therein. The roller is disposed in the chamber of the storing means. Means are provided for automatically moving the storing means toward the roller to provide a continuous supply of developer material thereto.

Still another aspect of the features of the present invention is a method of developing a latent image. The method includes the step of storing a supply of developer material in the chamber of the housing. A roller disposed in the chamber of the housing transports developer material into contact with the latent image to form a powder image thereof. The housing is moved automatically toward the roller to provide a continuous supply of developer material to the roller.

Finally, still another aspect of the features of the present invention is a method of electrophotographic printing in which an electrostatic latent image recorded on a photoconductive member is developed by a roller transporting developer material into contact therewith to form a powder image thereof. The method includes storing a supply of developer material in the chamber of a housing. This developer material is transported on a roller disposed in the chamber of the housing into contact with the latent image to form a powder image thereon. The housing is moved automatically toward the roller to provide a continuous supply of developer material to the roller.

Other aspects of the present invention will become apparent as the following description proceeds and upon reference to the drawings, in which.

While the present invention will hereinafter be described in connection with preferred embodiments and methods of use thereof it will be understood that it is not intended to limit the invention to these embodiments and methods of use. On the contrary, it is intended to cover alternatives, modifications and equivalents as may be included within the spirit and scope of the invention as defined by the appended claims.

Figure 1:
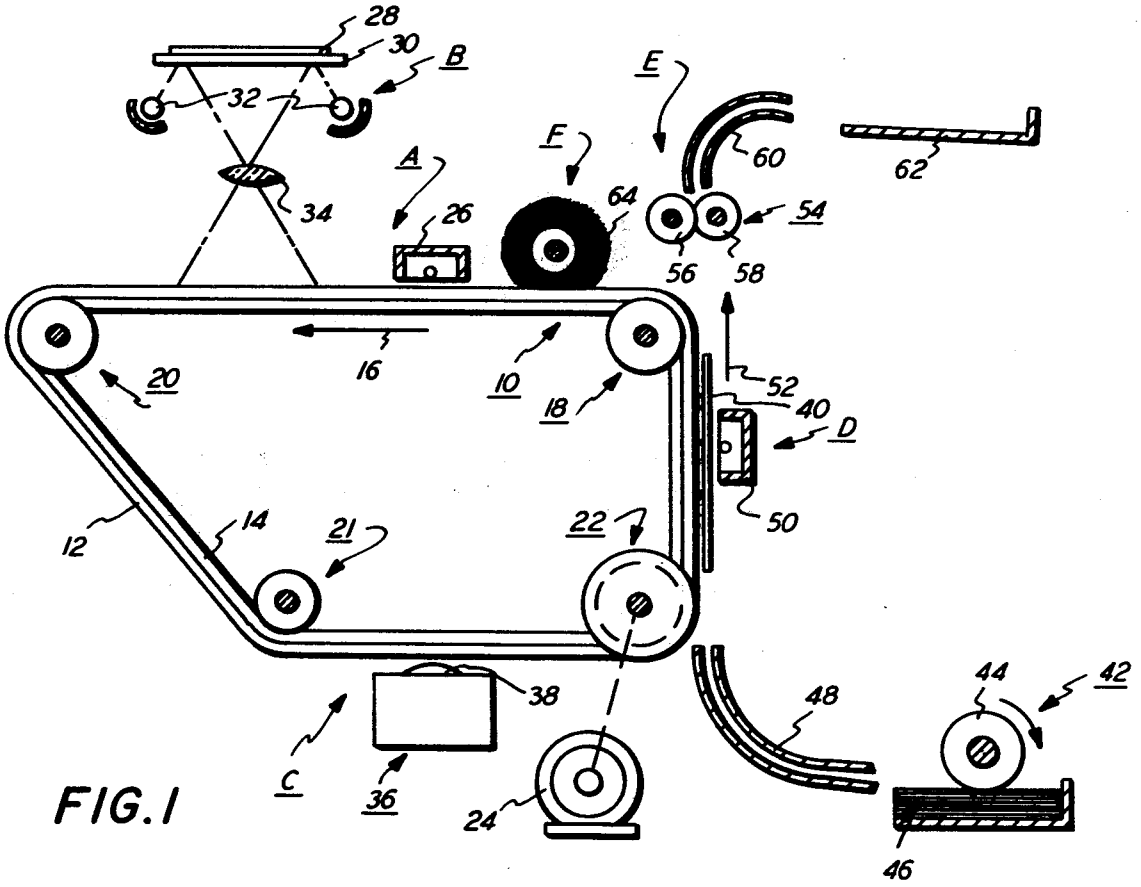
FIG. 1 is a schematic elevational view depicting an illustrative electrophotographic printing machine incorporating the features of the present invention therein.

For a general understanding of the features of the present invention, reference is made to the drawings. In the drawings, like reference numerals have been used throughout to designate identical elements. FIG. 1 schematically depicts the various components of an illustrative electrophotographic printing machine incorporating the development system of the present invention therein. It will become evident from the following discussion that this development system is equally well suited for use in a wide variety of reproducing printing machines and is not necessarily limited in its application to the particular embodiments depicted herein.

Inasmuch as the art of electrophotographic printing is well known, the features of the present invention will be depicted in an illustrative electrophotographic printing machine. The various processing stations employed in the illustrative printing machine of FIG. 1, will be shown hereinafter schematically and their operation described briefly with reference thereto.

Turning now to FIG. 1, the electrophotographic printing machine employs a belt 10 having a photoconductive surface 12 deposited on an electrically grounded conductive substrate. Preferably, photoconductive surface 12 is made from a selenium alloy with conductive substrate 14 being made from an aluminum alloy. Other suitable photoconductive surfaces and conductive substrates may also be employed. Belt 10 moves in the direction of arrow 16 to advance successive portions of photoconductive surface 12 through the various processing stations disposed about the path of movement thereof. As shown, belt 10 is entrained about a stripping roller 18, tension roller 20, idler roller 21 and drive roller 22. Drive roller 22 is mounted rotatably and in engagement with belt 10. Motor 24 rotates roller 22 to advance belt 10 in the direction of arrow 16. Roller 22 is coupled to motor 24 by suitable means such as a drive belt. Drive roller 22 includes a pair of opposed spaced edge guides. The edge guides define a space therebetween which determines the desired path of movement of belt 10. Belt 10 is maintained in tension by a pair of springs (not shown) resiliently urging tension roller 20 against belt 10 with the desired spring force. Stripping roller 18, tension roller 20 and idler roller 21 are mounted rotatably. These rollers rotate freely as belt 10 moves in the direction of arrow 16.

With continued reference to FIG. 1, initially a portion of belt 10 passes through charging station A. At charging station A, a corona generating device, indicated generally by the reference numeral 26, charges photoconductive surface 12 of belt 10 to a relatively high, substantially uniform potential.

Next, the charged portion of photoconductive surface 12 is advanced through exposure station B. At exposure station B, an original document 28 is positioned facedown upon a transparent platen 30. Lamps 32 flash light rays onto original document 28. The light rays reflected from original document 28 are transmitted through lens 34 forming a light image thereof. Lens 34 focuses the light image onto the charged portion of photoconductive surface 12 to selectively dissipate the charge thereon. This records an electrostatic latent image corresponding to the informational areas contained within the original document on photoconductive surface 12. Thereafter, belt 10 advances the electrostatic latent image recorded on photoconductive surface 12 to development station C.

At development station C, a magnetic brush development system, indicated generally by the reference numeral 36, transports a developer material into contact with the photoconductive surface 12. Preferably, the developer material comprises magnetic particles. Development system 36 includes a developer roller which attracts the magnetic particles thereto and advances these particles into contact with the photoconductive surface. The developer roller forms a brush of magnetic particles. The magnetic particles are attracted from the developer roller to the electrostatic latent image forming a powder image on photoconductive surface 12 of belt 10. A substantially flat surface is defined between rollers 21 and 22. Development system 36 is positioned in this flat region, i.e. interposed between rollers 21 and 22 and positioned closely adjacent to belt 10. The detailed structure of development system 36 will be described hereinafter with reference to FIGS. 2 through 5, inclusive.

After development, belt 10 advances the particle image to transfer station D. At transfer station D, a sheet of support material 40 is moved into contact with the powder image. The sheet of support material is advanced to transfer station D by a sheet feeding apparatus 42. Preferably, sheet feeding apparatus 42 includes a feed roll 44 contacting the uppermost sheet of stack 46. Feed roll 44 rotates to advance the uppermost sheet from stack 46 into chute 48. Chute 48 directs the advancing sheet of support material into contact with photoconductive surface 12 of belt 10 in a timed sequence so that the powder image developed thereon contacts the advancing sheet of support material at transfer station D.

Transfer station D includes a corona generating device 50 which sprays ions onto the backside of sheet 40. This attracts the powder image from photoconductive surface 12 to sheet 40. After transfer, the sheet continues to move in the direction of arrow 52 onto a conveyor (not shown) which advances the sheet to fusing station E.

Fusing station E includes a fuser assembly, indicated generally by the reference numeral 54 which permanently affixes the transferred powder image to sheet 40. Preferably, fuser assembly 54 includes a heated fuser roll 56 and a back-up roll 58. Sheet 40 passes between fuser roll 56 and back-up roll 58 with the powder image contacting fuser roll 56. In this manner, the powder image is permanently affixed to sheet 40. After fusing, chute 60 guides the advancing sheet 40 to catch tray 62 for subsequent removal from the printing machine by the operator.

Invariably, after the sheet of support material is separated from photoconductive surface 12 of belt 10, some residual particles remain adhering thereto. These residual particles are removed from photoconductive surface 12 at cleaning station F. Cleaning station F includes a pre-clean corona generating device (not shown) and a rotatably mounted fibrous brush 64 in contact with photoconductive surface 12. A pre-clean corona generating device neutralizes the charge attracting the particles to the photoconductive surface. These particles are then cleaned from photoconductive surface 12 by the rotation of brush 64 in contact therewith. Subsequent to cleaning, a discharge lamp (not shown) floods photoconductive surface 12 with light to dissipate any residual charge remaining thereon prior to the charging thereof for the next successive imaging cycle.

It is believed that the foregoing description is sufficient for purposes of the present application to illustrate the general operation of an electrophotographic printing machine incorporating the features of the present invention therein.

Figure 2:
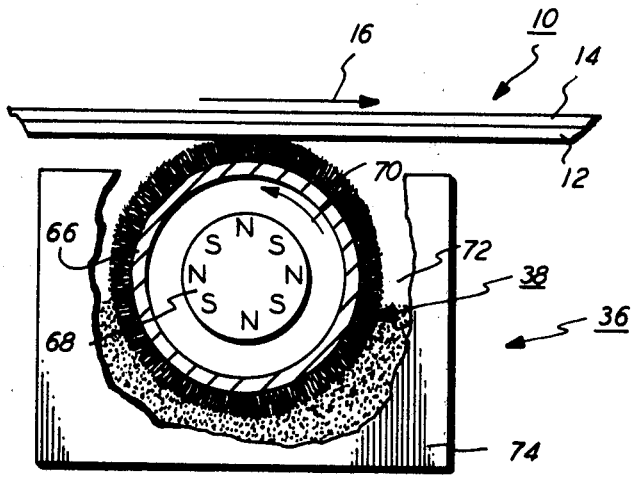
FIG. 2 is a schematic elevational view showing the development system of the FIG. 1 printing machine.

Referring now to FIG. 2, there is shown development system 36 in greater detail. As depicted thereat, development system 36 includes a developer roller 38 having a non-magnetic tubular member 66. An elongated magnetic member 68 is positioned interiorly of tubular member 66 and spaced from the interior periphery thereof. Preferably, tubular member 66 is stationary with magnetic member 68 rotating in the direction of arrow 70 so as to advance the developer material into contact with the electrostatic latent image recorded on photoconductive surface 12 of belt 10. However, one skilled in the art will appreciate that, alternatively, tubular member 66 may rotate with magnetic member 68 being stationary. As magnetic member 68 rotates in the direction of arrow 70, developer material in chamber 72 of housing 74 is attracted thereto. The developer material disposed in chamber 72 of housing 74 advances about tubular member 66 in a direction opposed to arrow 70 so as to move into contact with the electrostatic latent image recorded on photoconductive surface 12 of belt 10. The electrostatic latent image attracts the developer material thereto. Thus, developer material is being continually depleted from chamber 72 of housing 74. If additional developer material were not moved into contact with developer roller 38, eventually developer roller 38 would become starved for developer material and the copies would become progressively lighter and degradate in quality. To prevent the foregoing from occuring, housing 74 moves automatically toward developer roller 38 so as to provide a continuous supply of developer material thereto. Various embodiments of housing 74 and the structure for moving it toward developer roller 38 are shown in FIGS. 3 through 5, inclusive.

Figure 3:
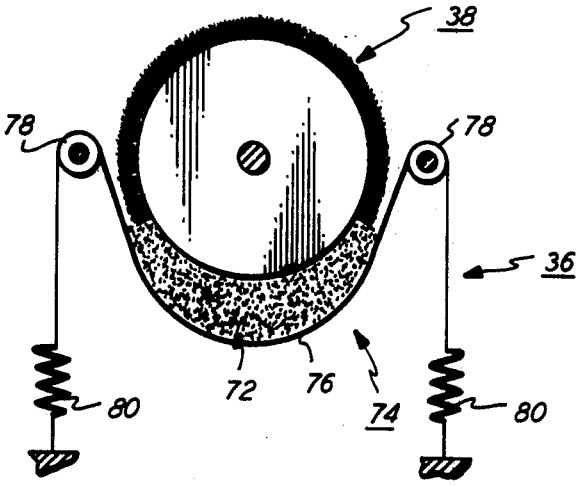
FIG. 3 is one embodiment for moving the housing of the FIG. 2 development system.

As shown in FIG. 3, development housing 74 is made from a flexible member 76. Flexible member 76 is entrained about pulley 78. Springs 80 are attached to flexible member 76. Thus, as developer material is depleted from chamber 72 of flexible member 76, springs 80 automatically move flexible member 76 toward developer roller 38 so as to maintain a continuous supply of developer material thereto. Thus, springs 80 automatically move flexible member 76 toward developer roller 38 in response to developer material being depleted from chamber 72 thereof.

Figure 4:
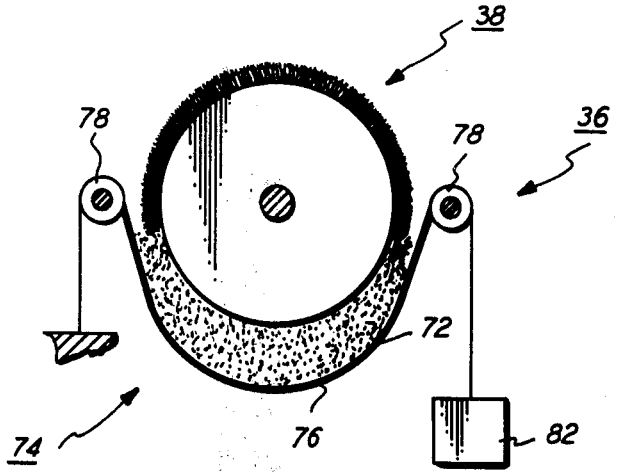
FIG. 4 is another embodiment for moving the housing of the FIG. 2 development system.
Figure 5:
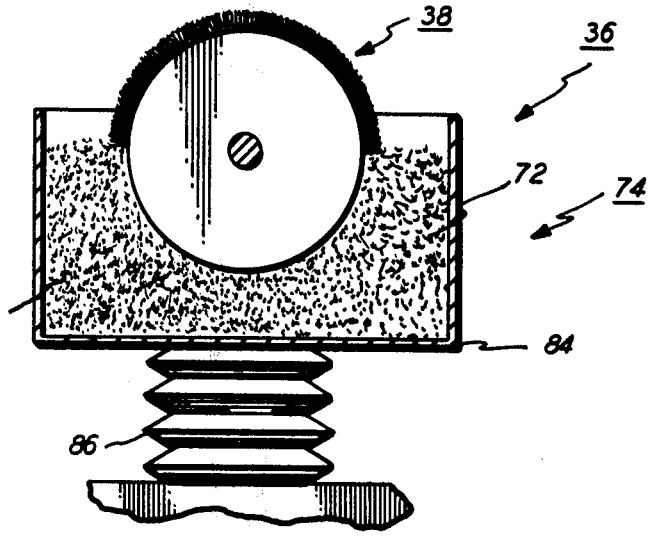
FIG. 5 is still another embodiment for moving the housing of the FIG. 2 development system.

Referring now to FIG. 4, there is shown another embodiment of development system 36. Once again, housing 74 is made from a flexible member 76 entrained about rollers 78. A fixed weight or counterbalance 82 is connected to flexible member 76. Thus, as developer material is depleted from chamber 72 of flexible member 76, weight 82 moves flexible member 76 toward developer roller 38. This insures that developer roller 38 continually receives developer material.

By way of example, flexible member 76 may be made from a metalized material such as Mylar.

FIG. 5 depicts still another embodiment of development system 36. In this embodiment, developer housing 74 is made from a substantially rigid member 84. Rigid member 84 is supported by a bellows 86. In this way, bellows 86 moves rigid member 84 toward developer roller 38 as developer material is depleted therefrom. This insures that a continuous supply of developer material is furnished to developer roller 38. Thus, as developer material is depleted from chamber 72 of rigid member 84, bellows 86 moves rigid member 84 toward developer roller 38. Hence, bellows 86 moves rigid member 84 toward developer roller 38 in response to developer material being depleted from chamber 72 thereof.

One skilled in the art will appreciate that the developer housing may be moved toward the developer roller in response to the number of latent images developed which corresponds to the number of copies reproduced, or the elapse of a pre-selected period of time. Furthermore, the development system of the present invention may also be employed to develop a magnetic latent image. Thus, the development system may develop either an electrostatic latent image or a magnetic latent image depending upon the characteristics of the reproducing machine.

In recapitulation, it is clear that the development apparatus of the present invention includes a housing storing a supply of developer material in a chamber thereof. A developer roller, positioned in the chamber of the housing, transports developer material into contact with a latent image. This develops the latent image to form a powder image thereof. The developer housing is automatically moved toward the developer roller in response to developer material being depleted from the chamber thereof. This insures that a continuous supply of developer material is furnished to the developer roller.

It is, therefore, evident that there has been provided, in accordance with the present invention, a development system which has a housing moved automatically toward a developer so as to maintain a continuous supply of developer material therefor. This development system fully satisfies the aims and advantages hereinbefore set forth. While this invention has been described in conjunction with various embodiments and methods of use thereof, it is evident that many alternatives, modifications and variations will be apparent to those skilled in the art. Accordingly, it is intended to embrace all such alternatives, modifications, and variations as fall within the spirit and broad scope of the appended claims.

What is claimed is:

1. An apparatus for developing a latent image including:

means, defining a chamber, for storing a supply of developer material therein;

means, disposed in the chamber of said storing means, for transporting the developer material into contact with the latent image to form a powder image thereof; and means for automatically moving said storing means toward said transporting means to provide a continuous supply of developer material to said transporting means.

2. An apparatus according to claim 1, wherein said moving means includes means for resiliently urging said storing means toward said transporting means in response to developer material being depleted from the chamber thereof.

3. An apparatus according to claim 2, wherein said resilient means includes a bellows supporting said storing means.

4. An apparatus according to claim 2, wherein said resilient means includes at least one spring supporting said storing means.

5. An apparatus according to claim 1, wherein said moving means includes means for applying a substantially uniform force to said storing means to move said storing means toward said transporting means in response to developer material being depleted from the chamber thereof.

6. An apparatus according to claim 5, wherein said applying means includes a weight coupled to said storing means.

7. An apparatus according to claims 1, 2, 3 or 4, wherein said storing means includes a flexible housing.

8. An apparatus according to claims 1, 5 or 6, wherein said storing means includes a substantially rigid housing.

9. An apparatus according to claim 1, wherein said moving means moves said storing means toward said transporting means in response to the number of latent images developed.

10. An apparatus according to claim 1, wherein said moving means moves said storing means toward said transporting means in response to the elapse of a pre-selected time period.

11. An apparatus according to claim 1, wherein the latent image is a magnetic latent image.

12. An apparatus according to claim 1, wherein the latent image is an electrostatic latent image.

13. An electrophotographic printing machine of the type having an electrostatic latent image recorded on a photoconductive member developed by a roller transporting developer material into contact with the latent image to form a powder image thereof, wherein the improvement includes:

means, defining a chamber, for storing a supply of developer material therein with the roller being disposed in the chamber of said storing means; and means for automatically moving said storing means toward the roller to provide a continuous supply of developer material to the roller.

14. A printing machine according to claim 13, wherein said moving means includes means for resiliently urging said storing means toward the roller in response to developer material being depleted from the chamber thereof.

15. A printing machine according to claim 14, wherein said resilient means includes a bellows supporting said storing means.

16. A printing machine according to claim 14, wherein said resilient means includes at least one spring supporting said storing means.

17. A printing machine according to claim 13, wherein said moving means includes means for applying a substantially uniform force to said storing means to move said storing means toward the roller in response to developer material being depleted from the chamber thereof.

18. A printing machine according to claim 17, wherein said applying means includes a weight coupled to said storing means.

19. A printing machine according to claims 13, 14, 15 or 16, wherein said storing means includes a flexible housing.

20. A printing machine according to claims 13, 17 or 18, wherein said storing means includes a substantially rigid housing.

21. A printing machine according to claim 13, wherein said moving means moves said storing means toward the roller in response to the number of latent images developed.

22. A printing machine according to claim 13, wherein said moving means moves said storing means toward the roller in response to the elapse of a pre-selected time period.

23. A method of developing a latent image, including the steps of:

storing a supply of developer material in the chamber of a housing;

transporting the developer material on a roller disposed in the chamber of the housing into contact with the latent image to form a powder image thereof; and moving automatically the housing toward the roller to provide a continuous supply of developer material to the roller.

24. A method according to claim 23, wherein said step of moving includes the step of resiliently urging the housing toward the roller in response to the developer material being depleted from the chamber thereof.

25. A method according to claim 23, wherein said step of moving includes the step of applying a substantially uniform force to the housing to move the housing toward the roller in response to developer material being depleted from the chamber thereof.

26. A method according to claim 23, wherein said step of moving includes the step of counting the number of latent images developed and moving the housing toward the roller in response to the elapse of a pre-selected number of developed latent images.

27. A method according to claim 23, wherein said step of moving includes the step of measuring the elapse of time and moving the housing toward the roller in response to the elapse of a pre-selected time period.

28. A method of electrophotographic printing in which an electrostatic latent image recorded on a photoconductive member is developed by a roller transporting developer material into contact with the latent image to form a powder image thereon, wherein the improvement includes the steps of:

storing a supply of developer material in the chamber of a housing with the roller being disposed therein; and moving automatically the housing toward the roller to provide a continuous supply of developer material to the roller.

29. A method according to claim 28, wherein said step of moving includes the step of resiliently urging the housing toward the roller in response to developer material being depleted from the chamber thereof.

30. A method according to claim 28, wherein said step of moving includes a step of applying a substantially uniform force to the housing to move the housing toward the roller in response to developer material being depleted from the chamber thereof.

31. A method according to claim 28, wherein said step of moving includes the step of counting the number of latent images developed and moving the housing toward the roller in response to the elapse and a pre-selected number of developed latent images.

32. A method according to claim 28, wherein said step of moving includes the step of measuring the elapse of time and moving the housing toward the roller in response to the elapse of a pre-selected time period.

* * * * *